United States Patent [19]

Lepach et al.

[11] Patent Number: 4,628,676

[45] Date of Patent: Dec. 16, 1986

[54] METHOD AND APPARATUS FOR LAYING STRANDED ROPE-LIKE MATERIAL ON A REEL

[75] Inventors: Werner Lepach; Herbert Horn, both of Schwabach, Fed. Rep. of Germany

[73] Assignee: Maschinenfabrik Niehoff KG, Schwabach, Fed. Rep. of Germany

[21] Appl. No.: 817,883

[22] Filed: Jan. 10, 1986

[30] Foreign Application Priority Data

Jan. 14, 1985 [DE] Fed. Rep. of Germany ..... 3500949

[51] Int. Cl.[4] ..... D07B 3/10; D07B 7/10; B65H 54/02; B65H 75/28

[52] U.S. Cl. ..... 57/266; 57/58.67; 57/71; 57/264; 57/265; 242/25 R; 242/35.5 A

[58] Field of Search ..... 57/264–266, 57/276, 58.49, 52.52, 58.65, 58.67, 58.68, 66, 66.5, 67–71; 242/25 R, 25 A, 35.5 R, 35.5 A, 35.6 R

[56] References Cited

U.S. PATENT DOCUMENTS

| | | | |
|---|---|---|---|
| 3,079,747 | 3/1963 | Burr | 57/58.67 |
| 3,368,336 | 2/1968 | Franzen | 57/58.67 |
| 3,429,115 | 2/1969 | Purdy et al. | 57/266 |
| 4,102,117 | 7/1978 | Dornberger | 57/264 X |
| 4,235,070 | 11/1980 | Bravin | 57/71 |
| 4,236,373 | 12/1980 | Bravin | 57/71 |
| 4,351,494 | 9/1982 | Schippers et al. | 242/35.5 A |
| 4,467,593 | 8/1984 | Araki | 57/264 X |
| 4,483,490 | 11/1984 | Engmann et al. | 242/25 R |
| 4,574,571 | 3/1986 | Thompson | 57/58.65 X |

*Primary Examiner*—John Petrakes

*Attorney, Agent, or Firm*—Kenyon & Kenyon

[57] ABSTRACT

A double-lay stranding machine for laying a predetermined amount of wire or stranded material on a reel comprises a lifting table for transfering empty reels to a reel carrier and for removing the full reels therefrom, the lifting table being provided with a pair of rollers for enabling the unwinding of a predetermined length of wire or strand from a wound reel during the removal process. The portion of the strand extending between a removed reel and a laying roller is automatically cut and held by a gripping and severing device. Upon the loading of an empty reel into the carrier, the leading free end portion of the wire or strand is automatically clamped to the outside surface of a reel flange and brought over the rim of the flange prior to a winding operation.

24 Claims, 14 Drawing Figures

METHOD AND APPARATUS FOR LAYING STRANDED ROPE-LIKE MATERIAL ON A REEL

BACKGROUND OF THE INVENTION

This invention relates to a method and an apparatus for laying stranded rope-like material on a reel having a sleeve flanked by a pair of flanges.

In conventional stranding or winding machines, most of the necessary procedural steps are manually performed. The loading and unloading of the reels has been automated to enable the employment of female operators incapable of moving heavy loads. See, for example, East German Patent No. 79 237.

Inasmuch as a major portion of the procedural steps, such as the severing of a strand or wire extending from a full reel and the refastening of the free end portion of the severed strand to an empty reel, is manually performed, the reduction of the setting-up time attributable to the automation of the unloading and loading processes is small, particularly when the cost of automation is considered. The decrease of the setting-up time is also relatively small in conventional partially automated double-lay stranding machines which operate with enforced control over a limited program cycle.

An object of the present invention is to provide an improved method and an improved apparatus of the above-described type.

Another object of the present invention is to provide such an apparatus which operates fully automatically over extended periods of time, e.g., at least for the duration of a personnel shift.

Another object of the present invention is to provide such an apparatus which operates fully automatically over an extended period of time without an appreciable change of the length of lay at a reel change and without excessive stretching of the strand of material.

Yet another object of the present invention is to provide a double-lay stranding machine suitable for an S- or Z-lay, which machine operates fully automatically over extended periods of time.

Another, particular, object of the present invention is to provide a method and apparatus for winding a strand of material on a reel in such a manner that an inner end of the strand of material is accessible without an unwinding of the coiled strand.

SUMMARY OF THE INVENTION

The present invention is directed in part to an apparatus for automatically laying stranded rope-type material on a reel having a sleeve with a longitudinal axis and a pair of flanges at opposite ends of said sleeve. In accordance with the invention, the apparatus comprises a carrier for holding the reel to enable rotation thereof about the longitudinal axis of the reel. A loading assembly is provided for automatically conveying the reel to the carrier prior to a winding operation and for automatically removing the reel from the carrier upon the completion of the winding operation. A first drive operatively coupled to the carrier rotates the reel about its longitudinal axis during the winding operation.

A strand laying assembly, including a shiftable laying roller, is provided for guiding a strand of material to the sleeve of said reel between the flanges thereof, the laying assembly further including a rotor yoke rotatable about the reel for feeding the strand to the laying roller during the winding operation. A second drive is operatively connected to the laying roller for reciprocating the roller along a path parallel to the longitudinal axis of the reel during the winding operation.

A first sensor monitors the amount of material wound on the reel, while a second sensor serves to detect whether the laying roller is located at a preselected position along the reciprocation path of the roller. A third sensor detects whether the reel has a preselected angular orientation with respect to a throw-over point at which an end portion of the strand passes over a flange of the reel. In addition, a fourth sensor detects whether the rotor yoke has a predetermined angular orientation.

Unwinding means is included in the loading assembly for automatically unwinding a predetermined length of the strand from the reel during removal of the reel from the carrier by the loading assembly. A gripping and severing device, engageable with a section of the strand extending between the reel and the laying assembly upon a removal of the reel from the carrier at termination of the winding operation, grips the strand section and cuts the strand at a point along the gripped section.

The winding apparatus includes a clamping device disposable at an outer side of one of the flanges of the reel upon a loading of the reel into the carrier, for clamping a free end of the strand prior to and during the winding operation. The winding apparatus in accordance with the invention further includes a guide disposable at a rim of the one flange for guiding the strand over the rim at the beginning of the winding operation.

A control unit is operatively connected to the first and the second drive and to the first, second, third and fourth sensors for terminating the winding operation upon (a) the winding of a predetermined length of the strand on the reel, (b) the attainment of the preselected position by the laying roller, (c) the attainment of the preselected angular orientation of the reel with respect to the throw-over point and (d) the attainment of the predetermined angular orientation by the rotor yoke. The control unit is operatively coupled to the loading assembly, the gripping and severing device and the clamping device for coordinating the operations thereof.

The invention is also directed to a method for automatically laying rope-type material on a reel having a sleeve with a longitudinal axis and a pair of flanges at opposite ends of said sleeve. The method in accordance with the present invention comprises the steps of (a) conveying the reel to a carrier prior to a winding operation, (b) mounting the reel to the carrier to enable rotation of the reel about its longitudinal axis, (c) clamping a free end of the strand prior to and during the winding operation, (d) guiding the strand over a rim of one of the flanges of the reel at the beginning of the winding operation, and (e) rotating the carrier and the reel about the longitudinal axis of the reel during the winding operation.

The method in accordance with the present invention includes the further steps of (f) guiding a strand of material by means of a laying roller to the sleeve of the reel between the flanges thereof, the step of guiding including the step of rotating a rotor yoke about the reel to feed the strand to the laying roller during the winding operation, (g) reciprocating the laying roller along a path parallel to the longitudinal axis of the reel during the winding operation, (h) monitoring the amount of material wound on the reel during the winding operation, (j) detecting whether the laying roller is located at a preselected position along the path, (k) detecting whether the reel has a preselected angular orientation with respect to a throw-over point at which an end portion of the strand passes over a flange of the reel, and (l) detecting whether the rotor yoke has a predetermined angular orientation.

In accordance with the method of the present invention, the winding operation is terminated upon the satisfaction of the following conditions: (i) the winding of a predetermined length of the strand on the reel, (ii) the attainment of the preselected position by the laying roller, (iii) the attainment of the preselected angular orientation of the reel with respect to the throw-over point and (iv) the attainment of the predetermined angular orientation by the rotor yoke. The reel is removed from the carrier upon the termination of the winding operation. During the removal of the reel, a predetermined length of the strand is unwound from the reel and a section of the strand extending between the reel and the laying roller is gripped, the strand being severed at a point along the gripped section.

Each step of the method in accordance with the present invention is automatically executed.

A method and an apparatus in accordance with the present invention yield the advantage of additional production capacity without the necessity of employing operating personnel. The increase in production capacity is achieved without an increase in the speed of revolution, i.e., the speed of winding.

Inasmuch as the free end portion of the strand of material to be wound on a reel is brought over the rim of a reel flange and clamped at the outer side of the flange, the free end portion becomes accessible for welding to an end of a strand section on another reel, whereby a stranded rope-like material of any desired length can be easily produced at a utilization site.

An apparatus in accordance with the present invention is characterized by a compact design requiring relatively little space in the manufacturing facility.

DETAILED DESCRIPTION

Figure 1:
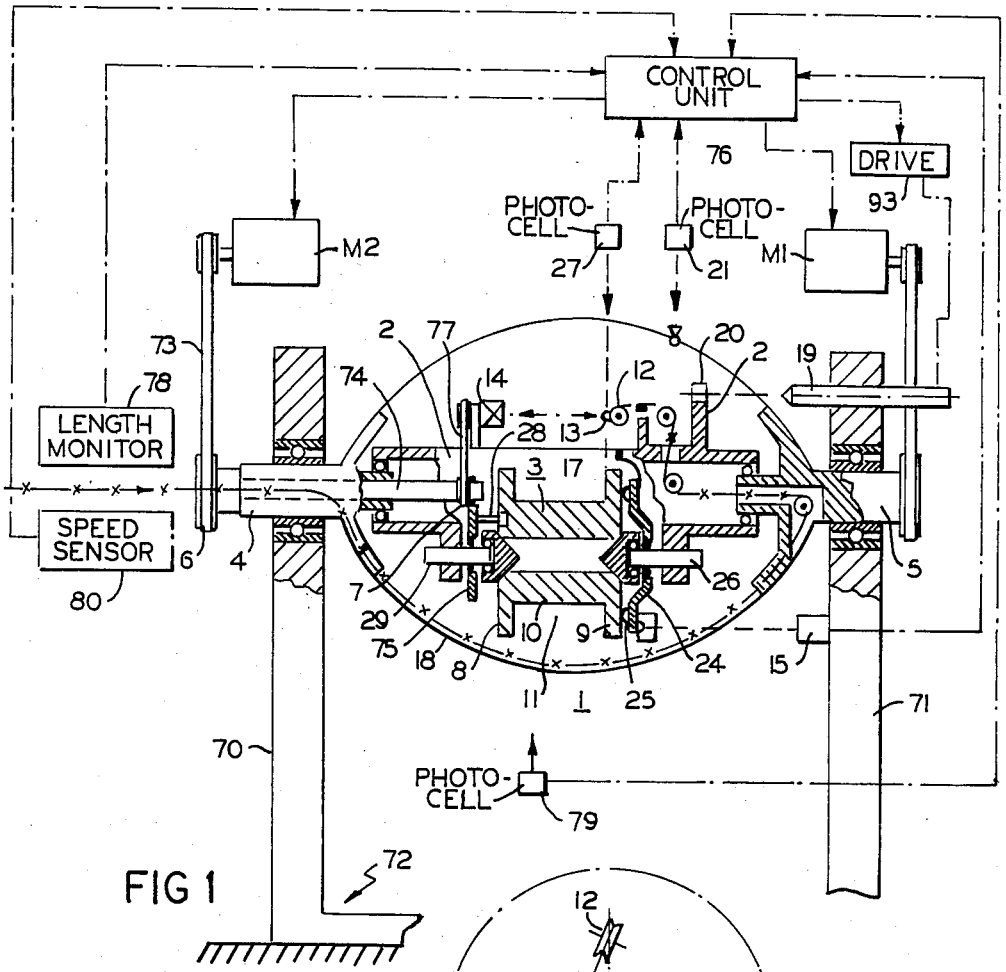
FIG. 1 is a schematic, partially cross-sectional view of a double-lay stranding or winding machine in accordance with the present invention.
Figure 3:
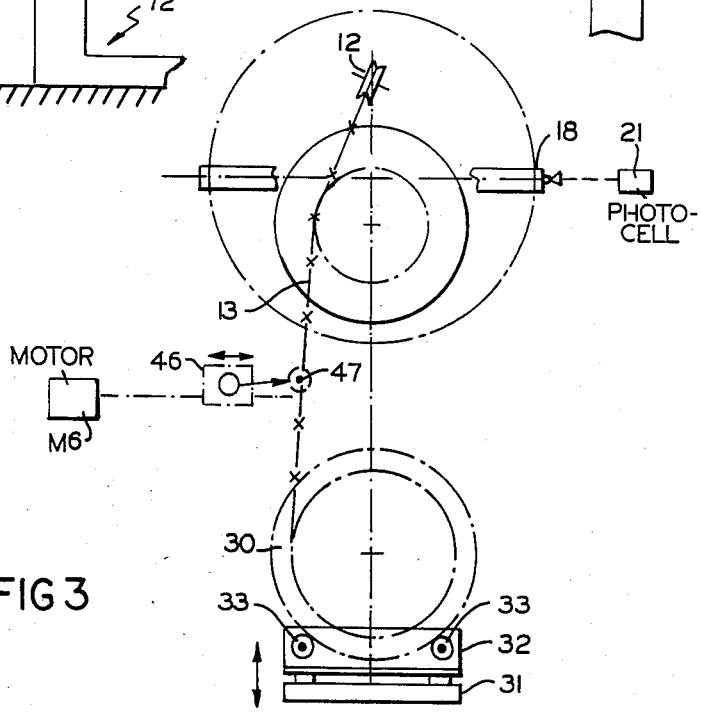
FIG. 3 is a schematic side view, taken from the left side of FIG. 1, showing as a solid line the position of a reel in a reel carrier during a winding operation and as a dot-dash line the position of the reel upon termination of the winding operation and removal of the reel from the reel carrier.

As illustrated in FIG. 1, a double-lay stranding machine in accordance with the present invention comprises a rotor 1 and a reel carrier 2. Rotor 1 includes a pair of rotor shafts 4 and 5 rotatably journaled in respective upright members 70 and 71 of a machine frame 72. Reel carrier 2 is rotatably mounted to rotor shafts 4 and 5 which are driven in a well-known manner by a motor M1 via a synchronizing shaft (not illustrated).

A reel 3 comprising a reel core or sleeve 10 flanked at opposite ends by a pair of circular flanges 8 and 9 is rotatably mounted to reel carrier 2 by means of a pair of spindles 26 and 29. During a winding operation, reel 3 is rotated about its longitudinal axis by a rotary drive motor M2. Rotary power is transmitted from motor M2 over a power transmission train including an endless belt 73, a planetary gear 6, a drive shaft 74, a disc 75 rotatably mounted to spindle 29 and a driver pin 28. Shaft 74 is provided at an end opposite planetary gear 6 with a circular array of teeth 7 which mesh with teeth on the outer periphery of disc 75.

Motors M1 and M2, as well as other operating devices described hereinafter, are alternately activated and deactivated by a control unit 76 in accordance with a preprogrammed operating sequence decribed hereinafter with reference to FIG. 14.

Core or sleeve 10 and flanges 8 and 9 of reel 3 define a toroidal winding space 11 which is filled with a wire or strand of other material 13 in a known manner by means of a reciprocating laying roller 12. The reversal of the motion of laying roller 12 is achieved by a mechanical reversing gear 14 operatively coupled with drive shaft 74 by means of an endless belt 77.

The size of a coil wound on reel 3 is measured by a length monitor or meter counter 78, monitor 78 being operatively connected to control unit 76 for transmitting thereto signals coding the length of wire or strand 13 which has passed the monitor. Alternatively, the degree of fullness of reel 3 may be determined in accordance with signals transmitted by a photosensitive device, e.g., a photocell 79, to control unit 76, photocell 79 being positioned to measure the depth of a coil disposed in winding space 11. As a further alternative, a speed sensor 80 may be juxtaposed to or engaged with wire or strand 13 as it is fed to the double-lay stranding machine.

The double-lay stranding machine in accordance with the invention is provided with a photosensitive device, e.c., a light gate or photocell 27, for detecting when the laying roller 12 is located in a region about flange 9 of the reel. The winding operation is arrested only when the laying roller is in the position illustrated in FIG. 1, so that the wire or strand 13 is juxtaposed to the inner side or surface of flange 9 during a removal operation. In addition, upon the winding of a predetermined amount of wire or stranded material on reel 3, the reel is stopped at a preselected angular orientation, defined by a throw-over point 55 of the wire or strand 13 over the rim of flange 9. The throw-over point is monitored by means of a photosensitive device (light gate or photocell) 15. Rays of light emitted by photosensitive device 15 are reflected by a marker 16 attached to a transfer baffle 17 in turn attached to a clamping disc 24 rotatably mounted to spindle 26. Light gate or photocell 15 is placed at such a position that, upon the termination of a winding operation and the stopping of reel 3, throw-over point 55 of wire or strand 13 over the rim of reel flange 9 is located at a predetermined position away from the lower portion of reel 3, whereby the end portion of wire or strand 13 at the throw-over point 55 does not come between reel flange 9 and rollers 33 of a lifting table 31 and is not damaged during a removal procedure.

Figure 2:
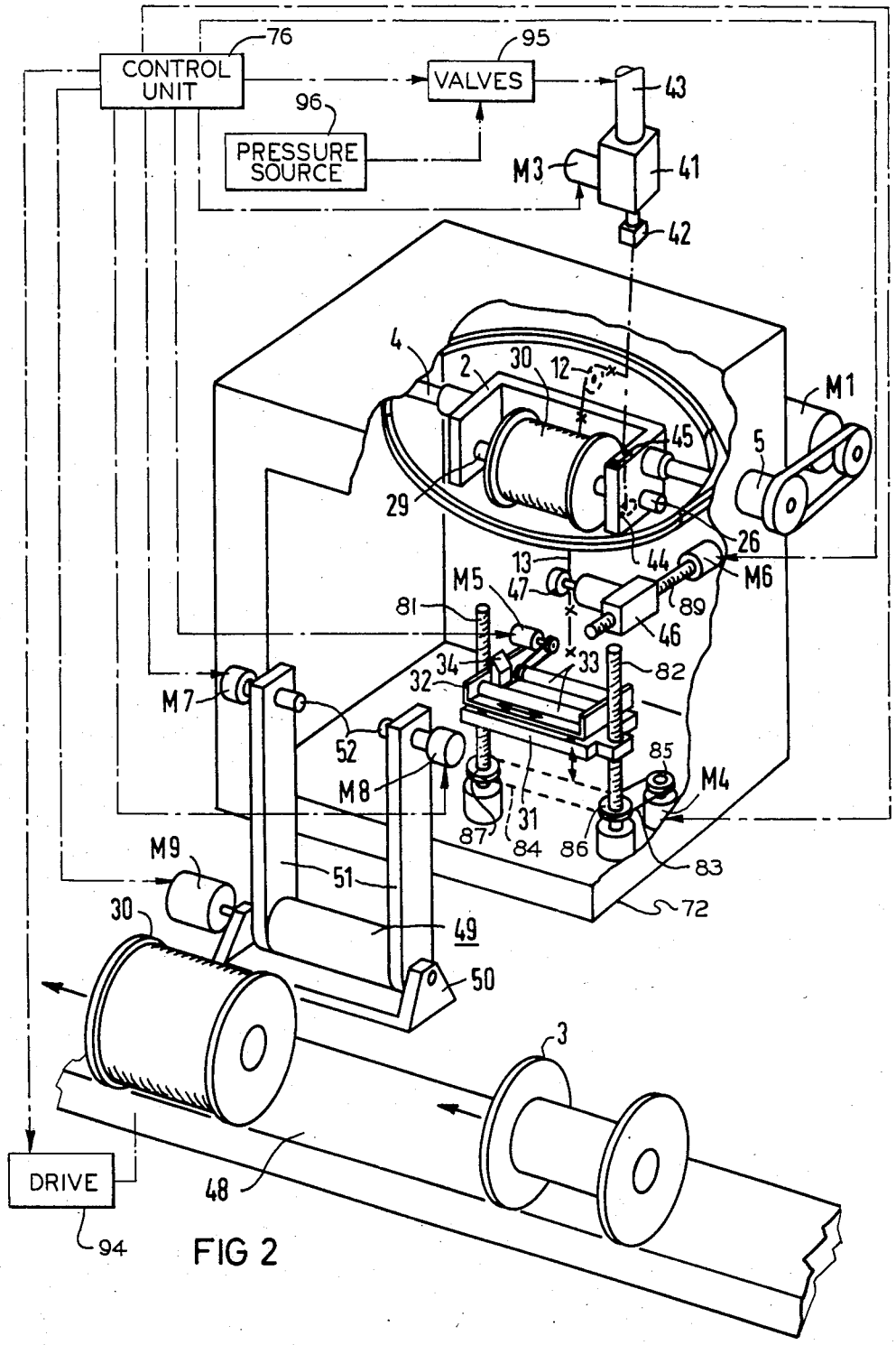
FIG. 2 is a perspective view of the double-lay stranding or winding machine of FIG. 1, illustrating a transport system for conveying reels to and from a reel carrier.

As illustrated in FIGS. 1 and 2, rotor 1 includes a pair of arcuate brackets or yokes 18 which define a plane. Upon the termination of a winding operation, the plane defined by yokes 18 is preferably approximately horizontal to facilitate removal of the full reel and the subsequent loading of an empty reel into carrier 2. To this end, the double-lay stranding machine is provided with another photosensitive device 21, i.e., a lightgate or photocell, for detecting whether the rotor yokes 18 have reached an approximately horizontal orientation. For purposes of facilitating the illustration of rotor 1, yokes 18 are shown in a vertical orientation in FIG. 1. However, it is to be understood that photocell 21 is located in such a position as to detect a horizontal positioning of rotor 1.

As illustrated in FIGS. 7–10, transfer baffle 17 is provided with a guide pin 22 for ensuring that wire or strand 13 is guided to reel core 10 over flange 9 from an outer side thereof during a first rotation of a winding operation. In the absence of transfer baffle 17 and guide pin 22, the wire or strand is transferred over the rim of flange 9 at an uncontrollable location and at an uncontrollable time after several rotations of the reel. Moreover, the wire or strand may be damaged if the rim has any rough areas.

On a side of clamping disc 24 opposite transfer baffle 17 is provided a counterweight 23 which acts as a "plumb bob" for determining by its weight the position of transfer baffle 17 upon the removal of a full reel from carrier 2. As shown in FIGS. 7–10, clamping disc 24 is provided on one side with an elastic pressure ring 25 which firmly presses wire or strand 13 against the outside surface of flange 9 upon the closure of spindle or sleeve 26. The resilence of pressure ring 25 prevents the strand or wire from being damaged.

As illustrated in FIG. 2, the double-lay stranding machine includes a lifting table 31 provided with a slide member 32. Lifting table 31 is mounted to frame 72 by means of a pair of rotatable screw members 81 and 82. Screw members 81 and 82 are turned by a motor M4 operatively connected to the screw members via a pair of endless belts 83 and 84 and a multiplicity of pulleys 85, 86 and 87.

Rotatably mounted to slide 32 are a pair of rollers 33 having respective axes of symmetry extending parallel to the longitudinal axis of reel 3 upon the loading thereof into carrier 2. One of the rollers 33 is rotatable about its axis of symmetry by a motor M5 attached to slide 32.

Figure 4:
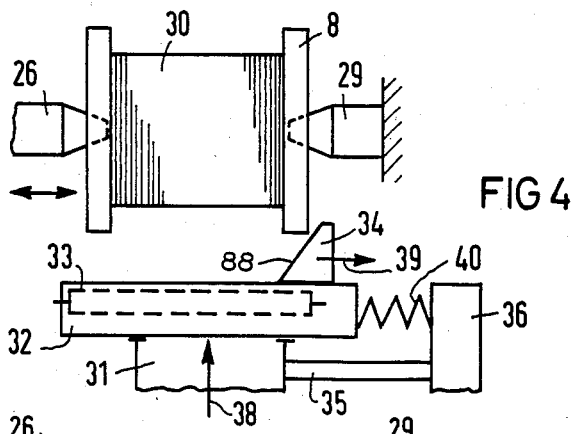
FIG. 4 is a schematic front elevational view of the reel in the reel carrier and of a lifting table for removing the reel from the carrier.
Figure 5:
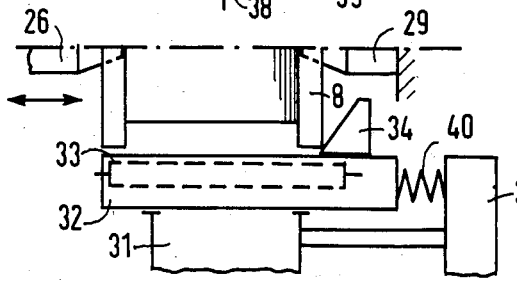
FIG. 5 is a schematic partial front elevational view similar to FIG. 4, showing the lifting table in an elevated position engaging the reel.
Figure 6:
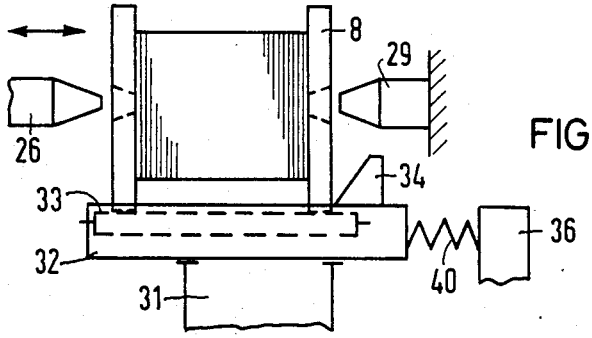
FIG. 6 is a schematic front elevational view similar to FIGS. 4 and 5, showing the reel removed from the reel carrier and deposited on the lifting table.
Figure 7:
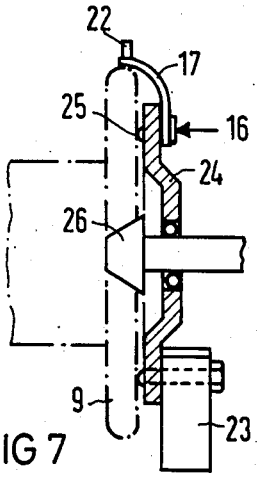
FIG. 7 is a schematic cross-sectional view of a clamping disc included in the reel carrier for clamping a free end portion of a strand of material to a flange of a reel.

As illustrated in FIGS. 4–6, a compression spring 40 is disposed between slide member 32 and a block 36 fixed to table 31 via a cantilevered arm 35. Slide 32 is provided with a wedge-shaped projection 34 which is engageable with a rim of reel flange 8 upon a raising of lifting table 31 under the action of motor M4. Upon the engagement of the flange rim by an inclined camming surface 88 of wedge-shaped projection 34, slide 32 is forced towards block 36 against the action of compression spring 40. FIG. 5 shows slide 32, together with rollers 33, shifted a maximum amount towards block 36 during the removal of a reel having a coil 30 of wire or strand 13 wound thereupon.

As illustrated in FIG. 2, the double-lay stranding machine is provided with a manipulator 41 attached to the plunger (not shown) of a hydraulic or pneumatic cylinder 43. Manipulator 41 includes a polygonal actuator 42 and a motor M3 activatable under the control of unit 76 for rotating the polygonal actuator to move spindle 26 alternately into a closed or operating position shown in FIGS. 1, 2, 4 and 5 and an open or disengaged position shown in FIG. 6. Upon the extension of manipulator 41, polygonal actuator or jaw 42 surrounds a polygonal pin 45 arranged on a spindle sleeve-operating gear 44 (FIG. 2). Upon the opening of spindle 26, i.e., upon the shifting of spindle 26 away from stationary spindle 29, reel 3 together with its coil 30, is slid off of spindle 29 by the action of compression spring 40. The released full reel is deposited on rollers 33. Motor M4 is then energized or actuated by control unit 76 to lower lifting table 31. The rotatability of rollers 33 prevents wire or strand 33 from becoming unduly stressed in tension during the lowering of reel 30. The rolls rotate in such a direction that a length of the strand is unwound from coil 30 during the lowering process. Motor M5 is energized by control unit 76 to facilitate the unwinding particularly in the case that wire or strand 13 is sensitive to stress.

A gripping and severing device 46 normally disposed outside the circle of revolution of yokes 18 is mounted to a drive member 89 in the form of a screw rotatable by a motor M6. Upon the lowering of a would reel by lifting table 32, motor M6 is energized by control unit 76 to move gripping and severing device 46 into the vicinity of a portion of wire or strand 13 extending between the coil 30 and laying roller 12. Gripping and severing device 46 is provided with gripping and cutting elements 47, as described and illustrated in detail in U.S. Pat. No. 4,292,114, particularly in FIGS. 4 and 4A of that patent.

The operation of the gripping and cutting elements 47 corresponds to the functions disclosed in connection with FIGS. 15–18 of U.S. Pat. No. 4,483,490. The gripping and cutting elements 47 are opened during the motion of device 46 towards the strand portion between laying roller 12 and coil 30. In the process, strand 13 is seized and the gripping and cutting elements 47 are closed so that strand 13 is severed, while the free end portion of the strand extending to roller 12 is clamped. This free end portion is brought between clamping disc 24 and reel flange 9 of an empty reel 3 and is clamped between the outer surface of that flange and pressure ring 25 prior to the commencement of a subsequent winding operation.

As illustrated in FIG. 2, full reels are transferred from lifting table 31 to a horizontal conveyor 48 by a fork-shaped arm 49 pivotably mounted to a bearing support 50. A motor M9 is operatively connected to arm or lever 49 for rotating the same from a vertical neutral position shown in FIG. 2 towards table 31 to enable removal of a full reel therefrom or for depositing an empty reel thereon. Likewise, motor M9 may be energized by control unit 76 to pivot arm 49 in an opposite direction to deposit a full reel on conveyor 48 or to remove an empty reel from the conveyor for subsequent deposition on rollers 33. Fork-shaped arm 49 is provided with a pair of parallel prongs 51 each carrying at an outer extremity a respective spindle or pin 52. Motors M7 and M8 are secured to respective prongs 51 and operatively coupled to respective pins 52 for rotating the pins in their journals and thereby moving them alternately towards and away from one another. The operation of the above-described transport system is schematically shown in FIG. 11.

Figure 11:
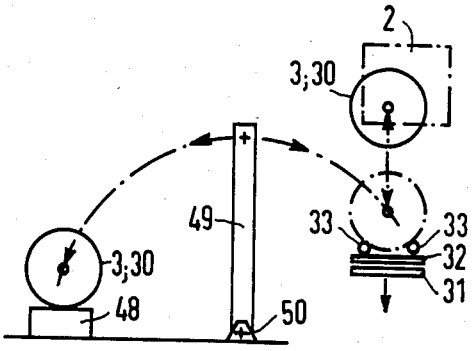
FIG. 11 is a schematic side elevational view of the transfer system of FIG. 2, including the lifting table of FIGS. 4–6.
Figure 12:
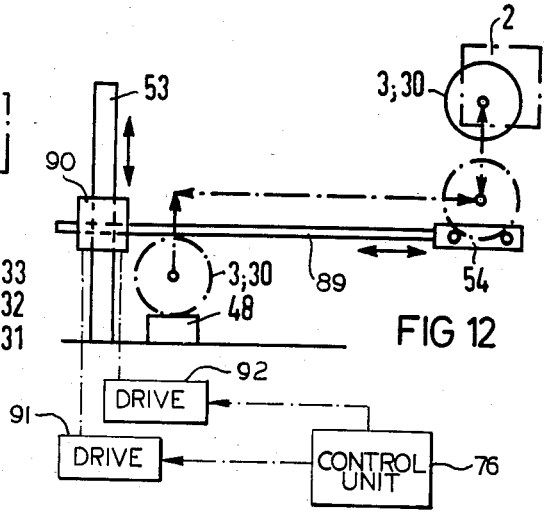
FIG. 12 is a side elevational view of a transfer system utilizable as an alternative to the transfer system of FIG. 11.

FIG. 12 illustrates transport system utilizable as an alternative to the transport system shown in FIG. 11. The alternative transport system comprises a support plate 54 mounted to an end of a horizontal arm 89 in turn shiftably secured to a support bracket 90 on a vertical post 53. Bracket 90, together with arm 89 and support plate 54, is movable in a vertical direction along post 53 by a drive 91. Similarly, arm 89 and support plate 54 are horizontally shiftable relative to bracket 90 by means of another drive 92. Both drives 91 and 92 may be operatively connected to control unit 76 for receiving activation and de-activation signals therefrom.

Figure 8:
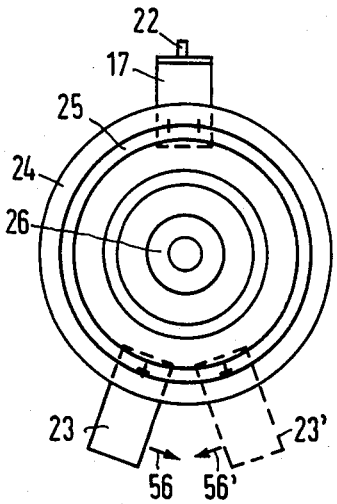
FIG. 8 is a side elevational view, taken from the right in FIG. 7, of the clamping disc illustrated in that figure.
Figure 9:
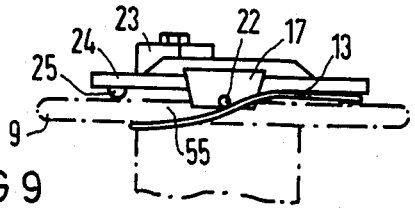
FIG. 9 is an elevational view of the clamping disc of FIGS. 7 and 8, showing the course of a wire or strand over a reel flange and a transfer baffle in the case of an S-lay.
Figure 10:
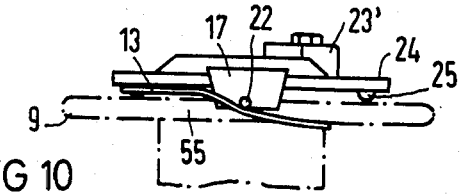
FIG. 10 is an elevational view similar to FIG. 9, showing the course of a wire or strand over a reel flange and a transfer baffle in the event of a Z-lay.

FIGS. 8, 9 and 10 show how for different directions of rotation of a reel to form an S-lay (FIG. 9) or a Z-lay (FIG. 10), the position of throw-over point 55 of wire or strand 13 over reel flange 9 can be changed. As illustrated in FIG. 8, weight 23 may be moved to a position 23' so that, prior to the clamping of an empty reel 3 by spindles 26 and 29 of carrier 2, weight 23 rotates clamping disc 24 in the directions indicated by arrows 56 and 56' so that throw-over point 55 arrives at the required location.

It is to be noted that motors M1–M9 may be electric motors or, alternatively, pneumatic, hydraulic or magnetic. Another drive 93 (see FIG. 1) of one of these types is operatively connected to alignment pin 19 and to control unit 76 for moving the pin into and out of engagement with recess 20 in carrier 2 in response to signals from control unit 76. Yet another such drive 94 (FIG. 2) is operatively coupled to conveyor 48 and control unit 76 for stepping the conveyor in response to signals from unit 76.

As illustrated in FIG. 2, control unit 76 is operatively connected to a set of valves 95 which control the flow of pressure from a pressure source 96 to pneumatic or hydraulic cylinder 43. Valves 95 are opened and closed in response to signals from control unit 76, whereby manipulator 41 is alternately raised and lowered at different times in the sequence of operating steps of the double-lay stranding machine in accordance with the invention.

Figure 13:
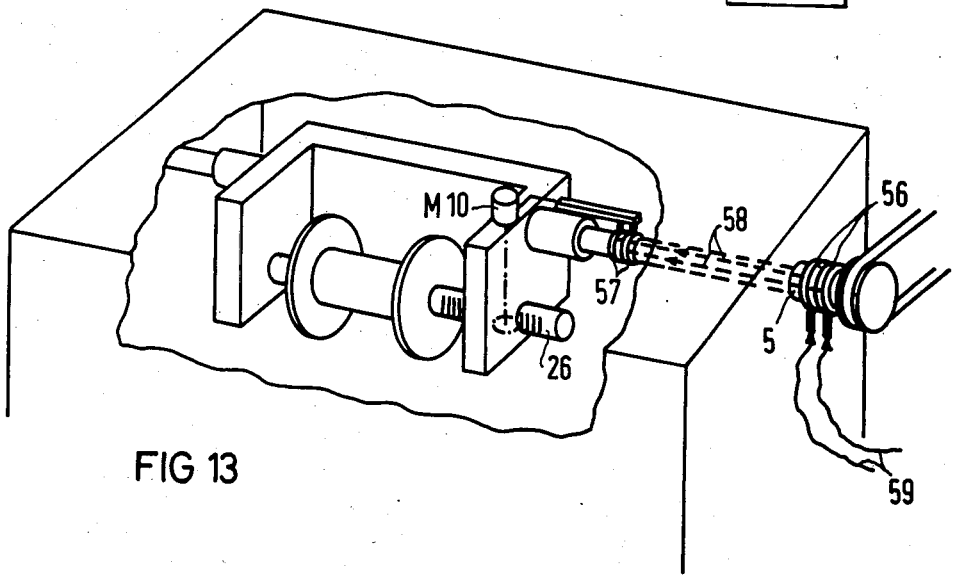
FIG. 13 is a schematic perspective view of a reel carrier and a mechanism for automatically opening and closing the reel carrier to respectively clamp and release a reel.

As illustrated in FIG. 13, the opening and closing of spindle or sleeve 26 may be controlled by an electric motor M10, instead of by manipulator 41. Electrical power is transmitted to motor M10 via a first set of conductors 59, a first set of slip rings 56, a second set of conductors 58, and a second set of slip rings 57. Conductors 58 are guided through rotor shaft 5.

Figure 14:
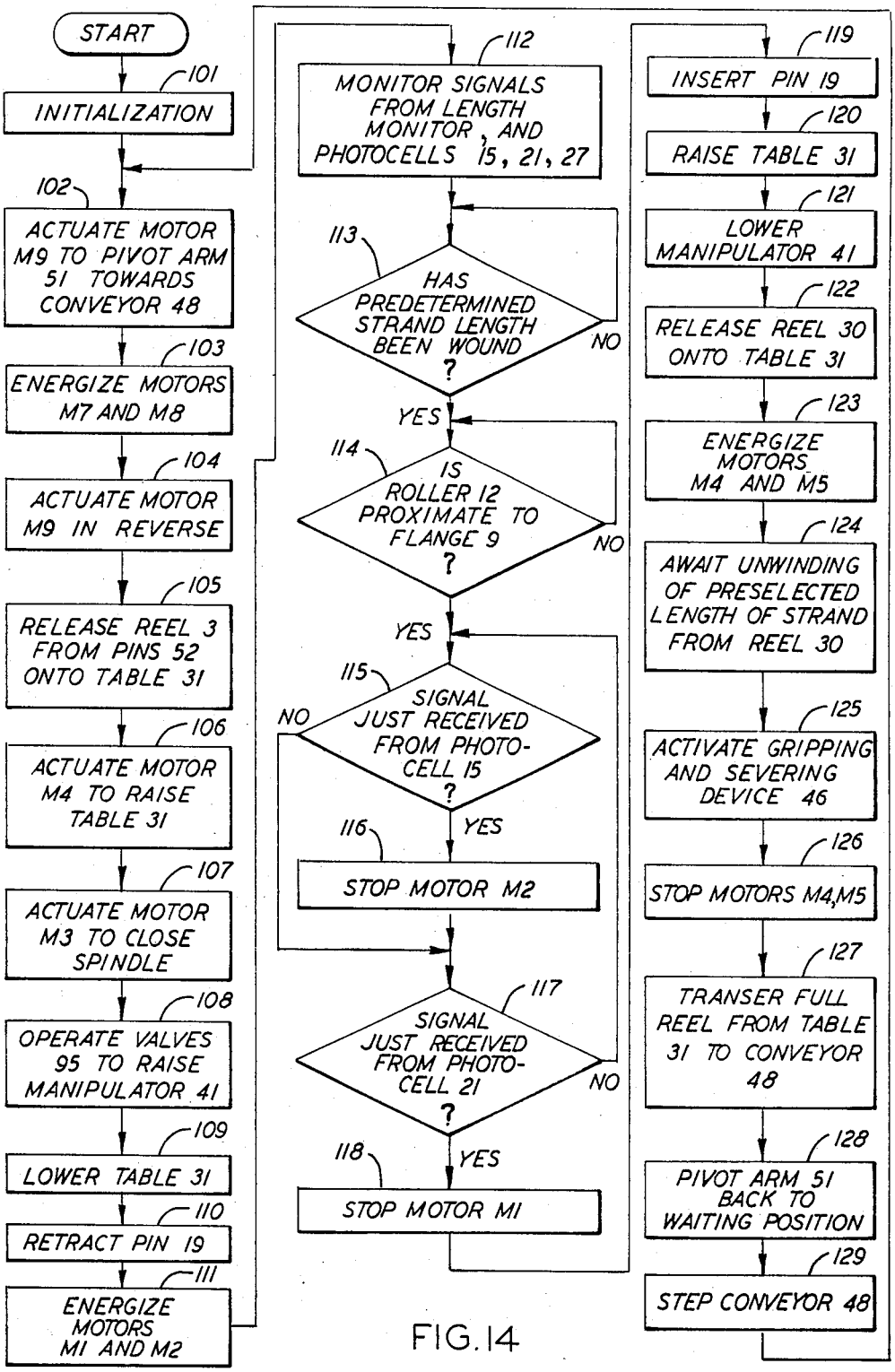
FIG. 14 is a block diagram illustrating a sequence of steps executed by a control unit shown in FIGS. 1 and 2.

As illustrated in FIG. 14, control unit begins with an initialization step 101 in which internal registers are reset and in which the control unit ensures that various components of the double-lay stranding machine are placed in starting positions. For example, control unit 76 activates drive 93 to ensure that pin 19 traverses opening or recess 20 in carrier 2, operates valves 95 and motor M3 to ensure that spindle 26 is in an opened position, energizes motor M4 to place table 31 in a lowered position and operates motor M6 if necessary to move gripping and severing device 46 to create a free path between area 2 and the lowered position of table 31. In a subsequent step 102, control unit 76 actuates motor M9 to pivot arm 51 towards conveyor 48. Control unit 76 then energizes in a step 103 motors M7 and M8 to move pins 52 towards one another, whereby the pins enter the longitudinal aperture defined by core or sleeve 10 of an empty reel 3.

In a step 104, control unit 76 actuates motor M9 in a reverse direction, whereby the empty reel is lifted from conveyor 48 and pivoted through a circular arc, as shown in FIG. 11, towards lifting table 31. Upon the pivoting of fork-shaped arm 51 through a predetermined angle, control unit 76 energizes motors M7 and M8 in a step 105 to release reel 3 from pins 52 onto lifting table 31. Motor M9 is then energized to pivot arm 51 into the vertical neutral position illustrated in FIG. 2, while motor M4 is energized in a step 106 to raise lifting table 31 from a lowered position towards carrier 2.

Upon the lapse of a predetermined period of time, necessary for lifting table 31 to reach an uppermost position wherein the empty reel is centered between spindles 26 and 29, control unit 76 actuates motor M3 to close spindle 26, i.e., to shift spindle 26 towards spindle 29 (step 107). In a subsequent step 108, control unit 76 operates valves 95 to raise manipulator 41 outside the circle of action of rotor yokes 18. In a series of steps 109–111, table 31 is lowered, pin 19 is retracted and motors M1 and M2 are energized to begin a winding operation. It is to be noted that prior to the commencement of the winding operation, the leading end portion of strand 13 is automatically clamped between the outside surface of flange 9 and resilient ring 25.

During the winding operation, control unit 76 monitors signals generated by length monitor 78 (or, alternatively, speed sensor 80 or photocell 79) and photosensitive devices 15, 21 and 27 (step 112). Control unit 76 then enters a loop in which it repeatedly inquires at decision junction 113 whether a predetermined strand length has been wound upon reel 3. In making the inquiry at decision junction 113, control unit 76 may, for example, compare the contents of an internal register (not illustrated), which counts pulses from length monitor 78, with a preselected value determined in part by the thickness of wire or strand 13. Upon the winding of a predetermined length, corresponding to a full reel, control unit 76 checks at a decision junction 114 whether roller 12 is proximately located to flange 9. Upon the receipt of a positive signal from photocell 27, control unit 76 enters a sequence of inquiries and steps 115–118 wherein the control unit stops motor M2 (step 116) if it determines at decision junction 115 that carrier 2 has reached an angular orientation in which throwover point 55 of strand or wire 13 is spaced from the lower region of reel flange 9. Similarly, control unit 76 stops motor M1 in step 118 upon determining at decision junction 117 that rotor yokes 18 have attained an approximately horizontal orientation.

The de-energization of motor M1 and M2 represents the termination of the winding operation and leads to a sequence of steps 119–122 wherein pin 19 is inserted into recess 20, table 31 is raised from a lowered position towards carrier 2, manipulator 41 is lowered, and the loaded reel is released onto table 31. In a subsequent step 123, control unit 76 energizes motors M4 and M5 to lower lifting table 31 and to rotate one of rollers 33 to unwind a predetermined length of strand 13 from coil 30. After waiting a predetermined about of time in a step 124, control unit 76 activates gripping and severing device 46 in a step 125 and de-energizes motors M4 and M5 in a step 126 substantially simultaneous with step 125. The full reel is then transfered in a step 127 from table 31 to conveyor 48. As heretofore described with respect to the transfer of the empty reel from conveyor 48 to table 31, the transfer process requires the control of the operation of motors M7–M9 by unit 76. Upon the completed transfer of the full reel to conveyor 48, control unit 76 pivots arm 51 back to the vertical waiting position illustrated in FIG. 2 (step 128). In a subsequent step 129, conveyor 48 is stepped by drive 94 in response to signals from control unit 76. The movement of the conveyor brings an empty reel into the loading position for transfer to table 31.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the descriptions and illustrations herein are proffered by way of example to facilitate comprehension of the invention and should not be construed to limit the scope thereof.

What is claimed is:

1. An apparatus for automatically laying stranded rope-type material on a reel having a sleeve with a longitudinal axis and a pair of flanges at opposite ends of said sleeve, comprising:

carrier means for holding the reel to enable rotation thereof about the longitudinal axis of the reel;

loading means for automatically conveying the reel to said carrier means prior to a winding operation and for automatically removing the reel from said carrier means upon the completion of said winding operation;

first drive means operatively coupled to said carrier means for rotating said reel about said longitudinal axis during said winding operation;

laying means including a shiftable laying roller for guiding a strand of material to the sleeve of said reel between the flanges thereof, said laying means further including a rotor yoke rotatable about said reel for feeding said strand to said laying roller during said winding operation;

second drive means operatively connected to said laying roller for reciprocating same along a path parallel to said longitudinal axis during said winding operation;

first sensor means for monitoring the amount of material wound on said reel;

second sensor means for detecting whether said laying roller is located at a preselected position along said path;

third sensor means for detecting whether said reel has a preselected angular orientation with respect to a throwover point at which an end portion of said strand passes over a flange of said reel;

fourth sensor means for detecting whether said rotor yoke has a predetermined angular orientation;

unwinding means mounted to said loading means for automatically unwinding a predetermined length of said strand from said reel during removal of said reel from said carrier means by said loading means;

severing means, engageable with a section of said strand extending between said reel and said laying means upon a removal of said reel from said carrier means at a termination of said winding operation, for gripping said section and cutting said strand at a point along said section;

clamping means, disposable at an outer side of one of the flanges of said reel upon a loading of said reel into said carrier means, for clamping a free end of said strand prior to and during said winding operation;

guiding means disposable at a rim of said one of said flanges for guiding said strand over said rim at the beginning of said winding operation; and control means operatively connected to said first and said second drive means and to said first, said second, said third and said fourth sensor means for terminating said winding operation upon (a) the winding of a predetermined length of said strand on said reel, (b) the attainment of said preselected position by said laying roller, (c) the attainment of said preselected angular orientation of said reel with respect to said throw-over point and (d) the attainment of said predetermined angular orientation by said rotor yoke, said control means being operatively coupled to said loading means, said severing means and said clamping means for coordinating the operations thereof.

2. The apparatus defined in claim 1 wherein said first sensor means comprises a device for measuring the length of said strand transferred to said reel.

3. The apparatus defined in claim 1 wherein said first sensor means comprises an optical device for detecting the diameter of a coil of said strand on said reel.

4. The apparatus defined in claim 1 wherein said first sensor means comprises a device for monitoring the speed of said strand during transfer thereof to said reel.

5. The apparatus defined in claim 1 wherein said third sensor means comprises a photosensitive device.

6. The apparatus defined in claim 1 wherein said fourth sensor means includes a photosensitive device.

7. The apparatus defined in claim 1 wherein said loading means includes a vertically shiftable lifting table.

8. The apparatus defined in claim 7 wherein said unwinding means includes a pair of rollers on said table.

9. The apparatus defined in claim 8 wherein said unwinding means further includes third drive means operatively linked to at least one of said rollers for rotating said one of said rollers upon a loading of said reel onto said table at the end of said winding operation.

10. The apparatus defined in claim 9 wherein said control means is operatively connected to said third drive means for controlling, in accordance with the diameter of a coil of said strand on said reel at the end of said winding operation and in accordance with a travel distance of said table, the magnitude of an angle through which said one of said rollers is rotated by said third drive means during a lowering of said reel from said carrier means.

11. The apparatus defined in claim 8 wherein said loading means includes a conveyor and a pivotably disposed arm for transfering empty reels to said table from said conveyor and for transfering wound reels to said conveyor from said table.

12. The apparatus defined in claim 8 wherein said rollers have respective axes of symmetry extending parallel to said longitudinal axis, said rollers being shiftable in the direction of said longitudinal axis.

13. The apparatus defined in claim 12 wherein said loading means further includes a slide shiftably mounted to said table for motion parallel to said longitudinal axis, said rollers being rotatably mounted to said slide, said slide being provided with means for shifting, upon an upward stroke of said table at the end of said winding operation, said slide and said rollers parallel to said longitudinal axis and against a force exerted by a spring, said means for shifting including a wedge-shaped block engageable with one of the flanges of said reel.

14. The apparatus defined in claim 1 wherein said carrier means includes a movable spindle sleeve having a closed operating position and an open disengaged position, further comprising third drive means operatively linked to said rotor yoke for rotating same about said longitudinal axis during said winding operation, further comprising manipulator means engageable with said spindle sleeve for closing same to clamp said reel in said carrier means prior to said winding operation and for opening said spindle sleeve to release said reel from said carrier means upon the termination of said winding operation, said manipulator means being disposed outside a circle of revolution of said rotor yoke during said winding operation, further comprising shifting means operatively coupled to said manipulator means for shifting same towards said carrier means upon completion of said winding operation.

15. The apparatus defined in claim 14 wherein said manipulator means includes a polygonal bolt.

16. The apparatus defined in claim 14, further comprising locking means engageable with said carrier means for fixing same in a predetermined configuration prior to engagement of said manipulator means with said carrier means, thereby ensuring proper cooperation between said manipulator means and said carrier means.

17. The apparatus defined in claim 16 wherein said locking means includes a bolt disposed outside said circle of revolution during said winding operation and further includes means for shifting said bolt to engage said carrier means prior to the commencement of said winding operation and upon the termination thereof.

18. The apparatus defined in claim 1 wherein said loading means includes a conveyor spaced from said carrier means and further includes a transport device for receiving said reel directly from said carrier means upon the termination of said winding operation, for lowering the wound reel upon receiving same from said carrier means, for moving said wound reel along a transport path to said conveyor and for bringing an empty reel from said conveyor to said carrier means along said transport path.

19. The apparatus defined in claim 1 wherein said clamping means includes a disc engageable with said outer side of said one of said flanges upon a loading of said reel into said carrier means.

20. The apparatus defined in claim 19 wherein said carrier means includes a movable spindle sleeve and wherein said disc is rotatably mounted to said spindle sleeve, said disc being provided with alignment means including a counterweight for swinging said disc into a predetermined angular orientation upon a removal of said reel from said carrier means.

21. The apparatus defined in claim 20 wherein said counterweight is removably attachable to said disc at a plurality of alternative locations.

22. The apparatus defined in claim 1 wherein said guiding means includes a transfer baffle, said transfer baffle being provided with a marking detectable by said third sensor means, said third sensor means including a photosensitive device.

23. The apparatus defined in claim 1 wherein said rotor yoke is rotated by menas of a rotor shaft and wherein said support means includes a movable spindle sleeve actuatable by an electric motor, further comprising power transmission means for supplying power to said electric motor, said power transmission means including a plurality of slip rings and a conductive line traversing said rotor shaft.

24. A method for automatically laying stranded rope-type material on a reel having a sleeve with a longitudinal axis and a pair of flanges at opposite ends of said sleeve, comprising the steps of:

conveying the reel to a carrier prior to a winding operation;

mounting the reel to said carrier to enable rotation of the reel about its longitudinal axis;

clamping a free end of said strand prior to and during said winding operation;

guiding said strand over a rim of one of the flanges of said reel at the beginning of said winding operation;

rotating said carrier and said reel about said longitudinal axis during said winding operation;

guiding a strand of material by means of a laying roller to the sleeve of said reel between the flanges thereof, said step of guiding including the step of rotating a rotor yoke about said reel to feed said strand to said laying roller during said winding operation;

reciprocating said laying roller along a path parallel to said longitudinal axis during said winding operation;

monitoring the amount of material wound about said reel during said winding operation;

detecting whether said laying roller is located at a preselected position along said path;

detecting whether said reel has a preselected angular orientation with respect to a throw-over point at which an end portion of said strand passes over a flange of said reel;

detecting whether said rotor yoke has a predetermined angular orientation;

terminating said winding operation upon (a) the winding of a predetermined length of said strand on said reel, (b) the attainment of said preselected position by said laying roller, (c) the attainment of said preselected angular orientation of said reel with respect to said throw-over point and (d) the attainment of said predetermined angular orientation by said rotor yoke;

removing said reel from said carrier upon the termination of said winding operation;

unwinding a predetermined length of said strand from said reel during removal of said reel from said carrier; and gripping a section of said strand extending between said reel and said laying means upon a removal of said reel from said carrier means at a termination of said winding operation and cutting said strand at a point along said section, each of said steps being automatically performed.

* * * * *